US007735567B2

(12) United States Patent
O'Mally et al.

(10) Patent No.: US 7,735,567 B2
(45) **Date of Patent: *Jun. 15, 2010**

(54) PACKER SEALING ELEMENT WITH SHAPE MEMORY MATERIAL AND ASSOCIATED METHOD

(75) Inventors: Edward J. O'Mally, Houston, TX (US); Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 293 days.

This patent is subject to a terminal disclaimer.

(21) Appl. No.: 11/404,130

(22) Filed: Apr. 13, 2006

(65) Prior Publication Data

US 2007/0240885 A1 Oct. 18, 2007

(51) Int. Cl.
*E21B 33/127* (2006.01)

(52) U.S. Cl. ..... 166/387; 166/179; 166/203

(58) Field of Classification Search ..... 166/387, 166/203, 179, 118
See application file for complete search history.

(56) References Cited

U.S. PATENT DOCUMENTS

| | | | | |
|---|---|---|---|---|
| 3,420,363 | A | 1/1969 | Blickensderfer | |
| 4,424,865 | A | 1/1984 | Payton | |
| 4,441,721 | A * | 4/1984 | Harris et al. | 277/342 |
| 4,515,213 | A * | 5/1985 | Rogen et al. | 166/123 |
| 4,554,973 | A | 11/1985 | Shonrock et al. | |
| 4,990,545 | A | 2/1991 | Hourai et al. | |
| 5,049,591 | A | 9/1991 | Hayashi et al. | |
| 5,145,935 | A | 9/1992 | Hayashi | |
| 5,941,313 | A | 8/1999 | Arizmendi | |
| 6,446,717 | B1 | 9/2002 | White et al. | |
| 6,583,194 | B2 | 6/2003 | Sendijarevic | |
| 6,598,672 | B2 * | 7/2003 | Bell et al. | 166/118 |
| 6,817,441 | B2 | 11/2004 | Murakami et al. | |
| 6,896,063 | B2 | 5/2005 | Chang et al. | |
| 7,234,533 | B2 * | 6/2007 | Gambier | 166/387 |
| 7,243,732 | B2 | 7/2007 | Richard | |

(Continued)

FOREIGN PATENT DOCUMENTS

DE 4122811 A1 1/1993

(Continued)

OTHER PUBLICATIONS

Gall, Ken, et al., Carbon Fiber Reinforced Shape Memory Polymer Composites, Journal of Intelligent Material Systems and Structures, vol. II, Nov. 2000, 877-886.

(Continued)

*Primary Examiner*—David J Bagnell
*Assistant Examiner*—David Andrews
(74) *Attorney, Agent, or Firm*—Steve Rosenblatt

(57) ABSTRACT

A packer or bridge plug uses a sealing element made from a shape memory polymer (SMP). The packer element receives heat to soften the SMP while the element is compressed and retained. While so retained, the heat is removed to allow the SMP to get stiff so that it effectively seals a surrounding tubular. High expansion rates are possible as the softness of the material under thermal input allows it to be reshaped to the surrounding tubular from a smaller size during run in and to effectively retain a sealed configuration after getting stiff on reduction in its core temperature while longitudinally compressed.

18 Claims, 1 Drawing Sheet

U.S. PATENT DOCUMENTS

Figure 1:
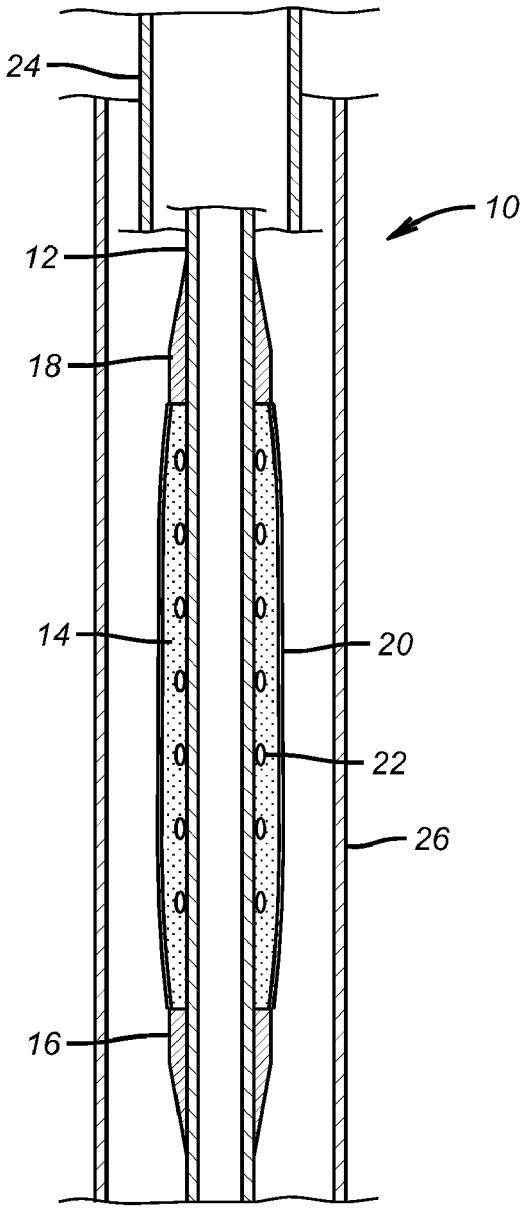

| | | | | |
|---|---|---|---|---|
| 2002/0166672 | A1* | 11/2002 | White et al. | 166/387 |
| 2003/0037921 | A1 | 2/2003 | Goodson, Jr. | |
| 2004/0194959 | A1 | 10/2004 | Chang et al. | |
| 2004/0194970 | A1* | 10/2004 | Eatwell et al. | 166/387 |
| 2005/0067170 | A1 | 3/2005 | Richard | |
| 2005/0199401 | A1* | 9/2005 | Patel et al. | 166/387 |
| 2006/0042801 | A1* | 3/2006 | Hackworth et al. | 166/387 |
| 2006/0219400 | A1 | 10/2006 | Xu et al. | |
| 2007/0163777 | A1* | 7/2007 | Murray et al. | 166/179 |
| 2007/0240877 | A1* | 10/2007 | O'Malley et al. | 166/179 |

FOREIGN PATENT DOCUMENTS

| | | | |
|---|---|---|---|
| WO | 02099246 | A1 | 12/2002 |

OTHER PUBLICATIONS

Tey, S J, et al., Influence of long-term storage in cold hibernation on strain recovery and recovery stress of polyurethane shape memory polymer foam, Smart Materials and Structures, Instutite of Physics Publishing, 2001, 321-325.

Liu, C., et al., Review of progress in shape-memory polymers, Journal of Materials Chemistry, The Royal Society of Chemistry, 2007, 1543-1558.

Coronado, Martin P., et al., Advanced Openhole Completions Utilizing a Simplified Zone Isolation System, SPE77438, Sep.-Oct. 2002, 1-11.

Song, G. Z., An Innovative Ultradeepwater Subsea Blowout Preventer (SSBOP) Control System Using Shape Memory Alloy Actuators, IADC/SPE 99041, Feb. 2006., 1-7.

Ma, Ning U., Design and Performance Evaluation of an Ultradeepwater Subsea Blowout Preventer Control System Using Shape Memory Alloys Actuators, SPE 101080, Sep. 2006, 1-8.

* cited by examiner

PACKER SEALING ELEMENT WITH SHAPE MEMORY MATERIAL AND ASSOCIATED METHOD

FIELD OF THE INVENTION

The field of the invention is packers and bridge plugs for downhole use and more particularly those that require high expansion in order to set.

BACKGROUND OF THE INVENTION

Packers and bridge plugs are used downhole to isolate one part of a well from another part of the well. In some applications, such as delivery through tubing to be set in casing below the tubing, the packer or bridge plug must initially pass through a restriction in the tubing that is substantially smaller than the diameter of the casing where it is to be set. One such design of a high expansion bridge plug is U.S. Pat. No. 4,554,973 assigned to Schlumberger. As an example, this design can pass through 2.25 inch tubing and still be set in casing having an inside diameter of 6.184 inches. The sealing element is deformable by collapsing on itself. The drawback of such a design is that setting it requires a great deal of force and a long stroke.

Another design involves the use of an inflatable that is delivered in the collapsed state and is inflated after it is properly positioned. The drawback of such designs is that the inflatable can be damaged during run in. In that case it will not inflate or it will burst on inflation. Either way, no seal is established. Additionally, change in downhole temperatures can affect the inflated bladder to the point of raising its internal pressure to the point where it will rupture. On the other hand, a sharp reduction in temperature of the well fluids can cause a reduction in internal sealing pressure to the point of total loss of seal and release from the inside diameter of the wellbore.

Conventional packer designs that do not involve high expansion use a sleeve that is longitudinally compressed to increase its diameter until there is a seal. In large expansion situations, a large volume of solid sleeve is needed to seal an annular space between a mandrel that can be 1.75 inches and a surrounding tubular that can be 6.184 inches. The solution has typically been to use fairly long sleeves as the sealing elements. The problem with longitudinal compression of a sleeve with a large ratio of height to diameter is that such compression doesn't necessarily produce a linear response in the way of a diameter increase. The sleeve buckles or twists and can leave passages on its outer surface that are potential leak paths even it makes contact with the surrounding tubular.

Shape memory polymers (SMP) are known for their property of resuming a former shape if subjected to a given temperature transition. These materials were tested in a high expansion application where their shape was altered from an initial shape to reduce their diameter with the idea being that exposure to downhole temperatures would make them revert to their original shape and hopefully seal in a much larger surrounding pipe. As it turned out the resulting contact force from the memory property of such materials was too low to be useful as the material was too soft to get the needed sealing force after it changed shape.

U.S. Pat. No. 5,941,313 illustrates the use of a deformable material within a covering as a sealing element in a packer application.

The preferred embodiment of present invention seeks to address a high expansion packer or bridge plug application using SMP and takes advantage of their relative softness when reaching a transition temperature where the SMP wants to revert to a former shape. Taking advantage of the softness of such a material when subjected to temperatures above its transition temperature, the present invention takes advantage of that property to compress the material when soft to reduce the force required to set. The SMP is constrained while the temperature changes and as it gets stiffer while retaining its constrained shape so that it effectively seals.

Those skilled in the art will better appreciate the various aspects of the invention from the description of the preferred embodiment and the drawings that appear below and will recognize the full scope of the invention from the appended claims.

SUMMARY OF THE INVENTION

A packer or bridge plug uses a sealing element made from a shape memory polymer (SMP). The packer element receives heat to soften the SMP while the element is compressed and retained. While so retained, the heat is removed to allow the SMW to get stiff so that it effectively seals a surrounding tubular. High expansion rates are possible as the softness of the material under thermal input allows it to be reshaped to the surrounding tubular from a smaller size during run in and to effectively retain a sealed configuration after getting stiff on reduction in its core temperature while longitudinally compressed.

DETAILED DESCRIPTION OF THE DRAWINGS

Figure 2:
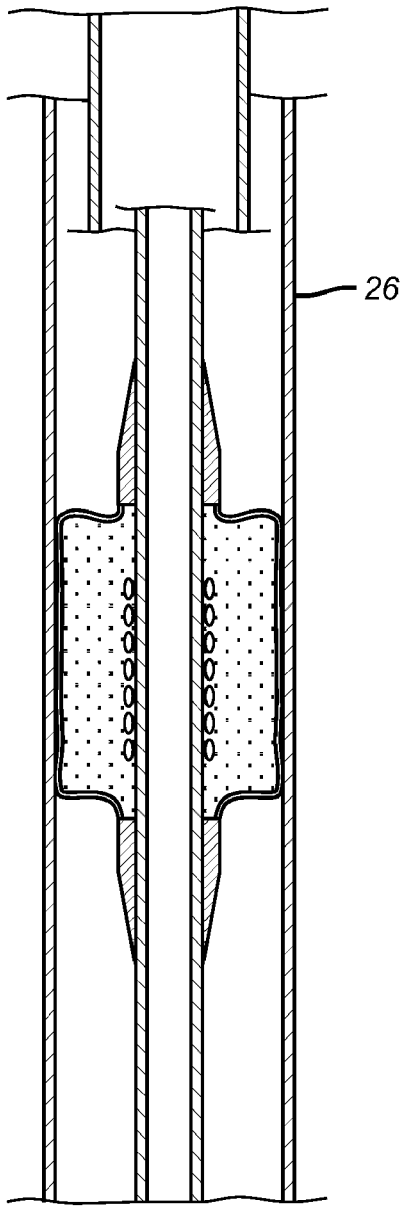

FIG. 1 is a section view in the run in position; and
FIG. 2 is a section view in the set position.

DETAILED DESCRIPTION OF THE PREFERRED EMBODIMENT

The packer or bridge plug 10 has a mandrel 12 and a sealing element 14 that is preferably slipped over the mandrel 12. Backup devices 16 and 18 are mounted over the mandrel 12 on either side of the element 14. One or both can be mounted to move along mandrel 12. They may be conical shapes or a petal design such as shown in U.S. Pat. No. 4,554,973 or other shapes to act as retainers for the element 14 and to act as transfer surfaces for applied compressive forces to element 14. They can be brought closer to each other to put the compressive loading on the element 14 through a variety of techniques including hydraulic pressure, setting down weight, gas generating tools or other equivalent devices to generate a longitudinal force.

Preferably, the element 14 is made from an SMP or other materials that can get softer and harder depending on the temperature to which they are exposed. As shown in FIG. 1 an outer cover 20 can be provided to encase the element 14. Preferably the cover is thin and flexible enough to minimize resistance to shape change in the element 14 created by relative movement of the backup devices 16 and 18. Preferably, the cover 20 is flexible to move with while containing the element 14 when its shape is changed during setting. It also provides protection for the element 14 during run in.

FIG. 1 further generically shows a heat source 22 that can affect the temperature of the element 14. While shown embedded in the element 14, it can be on its outer surface in contact with the cover 20 or it can generically represent a heat source that reaches element 14 from the surrounding well fluid. The source 22 can be a heating coil, materials that are initially separated and then allowed to mix on setting to create heat or other devices that create heat when needed to soften the element 14 for setting.

In operation, the packer or plug is located in the well. It may be delivered through tubing 24 into a larger tubular 26. Heat is applied from source 22. The element, when made of the preferable SMP material responds to the heat input and gets softer while trying to revert to its former shape. At the same time as the heat is applied making the element 14 softer, the backup devices 16 and 18 move relatively to each other to put a longitudinal compressive force on element 14 that is now easier to reconfigure than when it was run in due to application of heat from source 22. While applying compressive force to the element 14, the source 22 is turned off which allows the SMP of element 14 to start getting harder while still being subject to a compressive force. The compressive force can be increased during the period of the element, 14 getting stiffer to compensate for any thermal contraction of the element 14. Because the element 14 is softened up, the force to compress it into the sealing position of FIG. 2 is measurably reduced. Stiffness is considered in this application as the ability of the element to resist distorting force at a given degree of compression.

Alternative to adding heat through a heat source that is within the element 14, heat from the well fluid can be used to soften up element 14 if well conditions can be changed to stiffen up element 14 after it is set. For example if the onset of a flowing condition in the well will reduce the well fluid temperature, as is the case in injector wells, then the mere delivery of the packer 10 into the wellbore will soften up the element 14 for setting while allowing changed well conditions that reduce the fluid temperature adjacent the element 14 to allow it to get stiffer after it is set. While SMP materials are preferred, other materials that can be made softer for setting and then harder after setting are within the scope of the invention even if they are not SMP. Materials subject to energy inputs such as electrical to become softer for setting or that are initially soft and can be made harder after setting with such inputs are possibilities for element 14. Similarly materials whose state can be altered after they are set such as by virtue of a reaction by introduction of another material or a catalyst are within the scope of the invention. The invention contemplates use of an element that can be easily compressed to set and during or after the set start or fully increase in hardness so as to better hold the set. SMP represent a preferred embodiment of the invention. Multi-component materials that in the aggregate have one degree of stiffness that changes during or after compression to a greater stiffness are contemplated. One example is two component epoxies where the components mix as a result of expansion. In essence, the seal assembly undergoes a change in physical property during or after it is compressed apart from any increase in density.

The stimulus to make the change in physical property can come not only from an energy source within as shown in the Figures. The Figures are intended to be schematic. Energy sources external to the element 14 are contemplated that can come from well fluids or agents introduced into the well from the surface. The change of physical property can involve forms other than energy input such as introduction of a catalyst to drive a reaction or an ingredient to a reaction. The invention contemplates facilitating the compression of an element, which in the case of high expansion packers or bridge plugs becomes more significant due to the long stroke required and the uncertainties of element behavior under compression when the ratio of length to original diameter gets larger. In the preferred embodiment, using SMP with an internal energy source is but an embodiment of the invention.

The above description is illustrative of the preferred embodiment and many modifications may be made by those skilled in the art without departing from the invention whose scope is to be determined from the literal and equivalent scope of the claims below.

We claim:

1. An apparatus for selectively obstructing a wellbore, comprising:

a mandrel having a longitudinal axis:

a single material sealing element mounted on said mandrel, said element at least in part having a stiffness that initially decreases in response to heat;

a selectively operable heat source whose operation in the wellbore decreases the stiffness of said sealing element;

at least one backup device mounted outside said mandrel selectively movable in the wellbore independently of said heat source to longitudinally compress said element when its stiffness has been reduced by said heat source and increasing the diameter of said sealing element while shortening its length, while continuing to longitudinally compress and longitudinally contain said element after its stiffness increased from removal of said heat source.

2. The apparatus of claim 1, wherein:

the stiffness of the element is reduced in the wellbore before compression.

3. The apparatus of claim 1, further comprising:

an energy input into said element.

4. The apparatus of claim 3, wherein:

said energy input is embedded in said element.

5. The apparatus of claim 3, wherein:

said energy input is from a location exterior to said element.

6. The apparatus of claim 1, wherein:

said element comprises a shape memory polymer.

7. The apparatus of claim 6, wherein:

said element comprises a heat source mounted at least in part within said element.

8. The apparatus of claim 7, further comprising:

a flexible cover over said element that changes shape with said element.

9. A method of sealing a wellbore, comprising:

providing a sealing element assembly having a length on a mandrel, said assembly at least in part having a stiffness that decreases in response to selective application of heat and further is a single material that extends substantially for said length to seal the wellbore;

providing a selectively operable heat source;

running the mandrel in the wellbore; and compressing the element longitudinally from outside said mandrel with a device that operates independently of said heat source, after said running the mandrel into the wellbore, to increase its diameter to contact the wellbore when said heat source is applied and continuing said compressing as said heat source is removed and the stiffness of the sealing element assembly increases to hold a seal in the wellbore.

10. The method of claim 9, comprising:

using a shape memory polymer for said element assembly.

11. The method of claim 10, comprising:

providing energy to said element assembly to change its stiffness at a given degree of compression.

12. The method of claim 11, comprising:

covering said element assembly with a cover that conforms to shape changes of the element assembly from said compressing.

13. The method of claim 12, comprising:

changing the diameter of said element assembly by over a factor of 2 during said compressing.

14. The method of claim 13, comprising:

running said mandrel through tubing before said compressing.

15. The method of claim 11, comprising:

providing said heat before or during said compressing; and removing said heat during or after said compressing.

16. The method of claim 9, comprising:

providing energy to said element assembly to change its stiffness at a given degree of compression.

17. The method of claim 16, comprising:

embedding an energy source at least in part within the element assembly.

18. The method of claim 16, comprising:

using well fluids to provide said energy.

* * * * *